United States Patent [19]

Galluzzi et al.

[11] 4,365,555

[45] Dec. 28, 1982

[54] EXPLOSIVE PRIMING DEVICE

[75] Inventors: Giovanni Galluzzi, Lecco; Giulio Fiocchi, Milan, both of Italy

[73] Assignee: BERFI S.p.A., Milan, Italy

[21] Appl. No.: 165,367

[22] Filed: Jul. 2, 1980

[30] Foreign Application Priority Data

Jul. 4, 1979 [IT] Italy ..... 24094 A/79

[51] Int. Cl.[3] ..... F42C 19/10

[52] U.S. Cl. ..... 102/204

[58] Field of Search ..... 102/204, 202, 275.11, 102/275.9

[56] References Cited

U.S. PATENT DOCUMENTS

| | | | |
|---|---|---|---|
| 679,792 | 8/1901 | Stuart | 102/204 |
| 2,853,007 | 9/1958 | Casati | 102/204 |
| 3,994,235 | 11/1976 | Politzer et al. | 102/204 |
| 4,027,592 | 6/1977 | Hubsch et al. | 102/202 |

FOREIGN PATENT DOCUMENTS

| | | |
|---|---|---|
| 1474104 | 5/1977 | United Kingdom . |
| 2009373 | 6/1979 | United Kingdom . |

*Primary Examiner*—Charles T. Jordan

*Attorney, Agent, or Firm*—Martin Smolowitz

[57] ABSTRACT

The invention relates to a priming device for explosive projectiles and explosive chains, comprising a casing (10), provided with a through hole (11) in which a percussion pin (12) is slidably positioned, and a die member (22), removably mounted to the casing, in which an explosion chamber (21) of frusto-conical shape and with blind bottom is provided, longitudinal slots (25) and other ducts (27, 28) permitting the explosion gases, as generated by a caseless explosive pill (20), to be conveyed to a main explosive charge.

5 Claims, 2 Drawing Figures

EXPLOSIVE PRIMING DEVICE

BACKGROUND OF INVENTION

Figure 1:
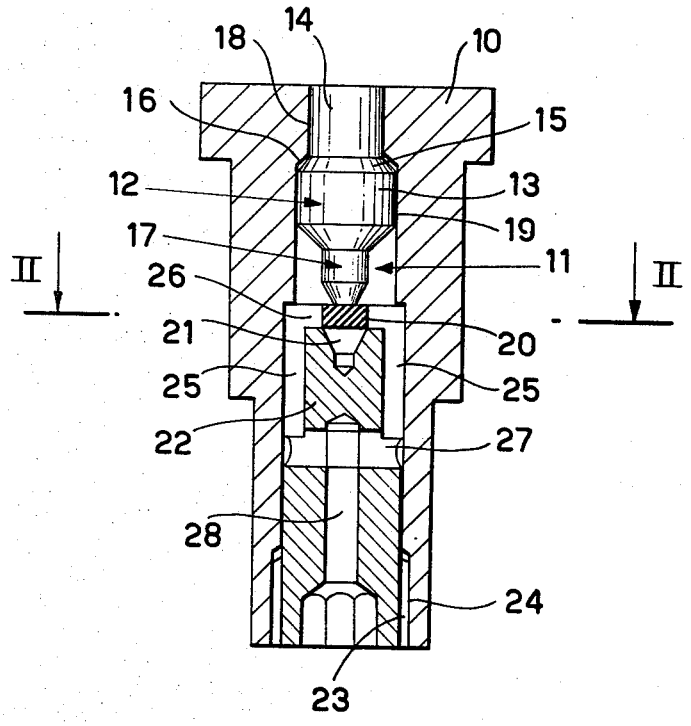

The present invention relates to an explosive priming device, more particularly of the type comprising a pill of explosive material.

It is known that for every type of explosive device, both in form of a projectile (this word having to be understood in its most general meaning), or in form of an explosive chain, there is necessary a primer normally comprising a highly explosive material which, owing to a mechanical, chemical or thermal action, generates high temperature and/or pressure gases, capable of activating the explosion of the main explosive charge or of the subsequent charge in the case of an explosive chain.

The problems and drawbacks of the already known primers and their importance do not need much comments: it is enough to remember that the successful outcome or the failure, from the point of view of the operation, of the projectile depends on the right operation of the priming device. According to the conventional embodiments, the priming devices are inserted in the bottom of the projectile, so as to be struck by the percussion pin and start the explosion of the main charge. Such a construction gave place to a strong limitation as regards the use of the subject projectiles and particularly as regards the firing rate, owing to the need of taking into account, in the operating sequence, also the step of the cartridge-case ejection.

Furthermore, but not of less importance, there exists the problem of the storage and of the handling of the explosive devices, which require, owing to the presence of the primers (highly sensitive), particular care and cautions, under penalty of accidental explosions with very serious consequences.

In the field of particular explosive operated devices, namely of the tools capable of driving nails and like pointed elements due to the action of an explosive charge, in recent years there appeared the models in which the explosive charge for the driving of the point or nail consists of a pill of an explosive material, possibly coated with a protection paint, the percussion of this pill giving place to the desired explosion, without the need of cartridge cases or of priming caps and without the necessity of foreseeing, in the firing sequence, a step for the case ejection. With reference to this type of explosive charge there has also been described a firing device for explosive pills of the aforesaid type, particularly applied to the aforesaid tools for driving pointed elements and nails, this device comprising an explosion chamber of frusto-conical shape, having blind bottom and of suitable size, the explosive pill being positioned against the open end of the chamber: the percussion of the pill causes the same or a central portion thereof to penetrate into the said explosion chamber with an adiabatic compression of the air present in the same chamber whereby the air achieves, practically instantaneously, temperature and pressure conditions such as to ensure the explosion of the pill.

SUMMARY OF INVENTION

It has been now found that, on the basis of the above mentioned principle, it is possible to essentially eliminate the problems and drawbacks, as previously shortly stated, of the priming devices. More particularly the main purpose of the present invention is that of providing a caseless explosive priming device, adapted to be mounted, at the time of the use, to the explosive charge or explosive chain to be primed. Another purpose of the present invention is that of providing a priming device of the aforesaid type which remains attached to the main explosive charge, with which it is in direct communication through a duct for conveying the explosive gases as generated by the priming device.

These and other purposes are achieved by means of an explosive priming device, comprising a pill of explosive material, covering the open end of a frusto-conical, blind, bottomed explosion chamber, and a percussion pin adapted to strike said pill at the opposite side with respect to the said explosion chamber, characterized in that it comprises a casing or body part having a through hole, at one end of which the said percussion pin is slidably mounted, without the possibily of coming out of the hole, whereas at the opposite end a die member is removably mounted, the said explosion chamber being formed at the end of the die member which is more internally positioned with respect to the said through hole, channels being provided in said die member by which said explosion chamber communicates with an axial duct formed in said die member and in turn leading outwardly.

According to the preferred embodiment of the explosive priming device of the present invention, said die member is screwed in said through hole, so as to lock said explosive pill against the inner end of the percussion pin and the said casing or body part is shaped so as to be readily mountable to the main explosive charge.

IN THE DRAWINGS

Figure 2:
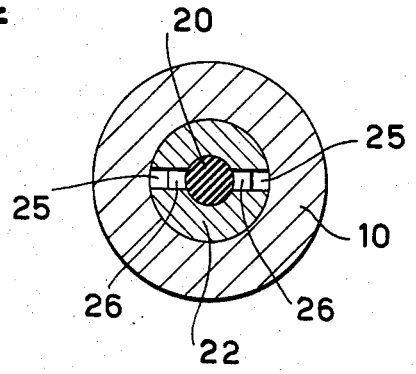

The particular features and the advantages of the present invention shall be more clearly understood from the following detailed description of a preferred embodiment referring to the enclosed drawings, in which:

FIG. 1 is a longitudinal cross-section view of the explosive priming device, and FIG. 2 is a transverse cross-section view, according to the lines II—II of FIG. 1.

DESCRIPTION OF INVENTION

Referring to the drawings, the explosive priming device of the invention comprises a casing 10, preferably of steel material and having a through hole 11, comprising different diameter sections along its length.

The casing 10 is externally shaped so as to permit the same to be readily mounted to a main explosive charge or to the first explosive charge of an explosive chain (not shown), so as to convey to the same the discharge gases of the explosion of the priming device.

At one end of the through hole 11 the percussion pin 12 is slidably located, it comprising a middle section 13 of greater diameter, which is connected to the end section 14, of reduced diameter, by means of a frusto-conical part 15, adapted to fit together with a corresponding part 16 of the said through hole 11: the latter, consequently, comprises a first portion 18, having a diameter corresponding to that of the said end section 14, and a second portion 19, having diameter corresponding to that of the middle section 13, whereas the frusto-conical part 16 prevents the percussion pin from coming out through the end section 14.

The percussion pin lastly comprises the proper percussion end, as generally indicated by the reference 17, having diameter less than that of the said through hole in the part 19, said percussion end being into contact with the explosive pill 20, of the already mentioned type.

The latter is positioned into contact with the mouth of the explosion chamber 21, of frusto-conical shape and having blind bottom, which is formed in the upper end of a die member 22, which is introduced through the opposite end with respect to that in which said percussion pin is located; it is to be pointed out that the positioning of the die member in the through hole 11 and the tightening of the same causes the explosive pill 20 to be locked between the explosion chamber 21 and the lower end of the percussion pin 12.

At the end of the die member 22 bearing the explosion chamber two surface longitudinal slots 25 are formed, which at their upper end communicate with radial ducts 26 provided correspondingly to the explosive pill 20, whereas at their lower end communicate with a transverse duct 27, the latter being in turn freely communicating with and axial duct 28, formed in the die member 22, to convey the explosive gases, as generated in the chamber 26, to the main explosive charge or to the first charge of the explosive chain, (not shown), with which the conveying duct 28 is freely communicating.

It is to be noted that the end part of the axial duct 28 is of polygonal cross section, to make it easier the fastening by means of a suitable wrench.

Thus the operation of the priming device of the present invention is clearly understood:

Once it is inserted in the explosive device or at the beginning of the explosive chain, the percussion pin is struck through the corresponding end of the through hole 11, whereby the explosive pill 20, or part thereof, carries out the adiabatic compression of the air contained in the frusto-conical chamber 21, thus causing the deflagration of the pill. The gases resulting from such an explosion are conveyed through the radial ducts 26, the channels 25, the tranverse duct 27 and the conveying duct 28 to the main charge, causing the explosion thereof. From the preceding description, having illustrative but not limiting meaning, (since modifications and changes, which are conceptually and mechanically equivalent, are possible and can be foreseen without falling out of the scope of the present invention), the main advantages of the present invention are clear as hereinafter shortly resumed:

(1) The explosive priming device is mounted to the main explosive charge only when necessary, namely close to the time foreseen for the use.

(2) The risks of accidental explosions of the main charge, as caused for instance by inaccurate handling, are eliminated.

(3) The cases of delayed operation or of failure of the priming device are essentialy reduced, it being possible, in the second instance, to readily replace the priming device, the main charge being maintained unchanged.

(4) The same priming device can be readily dismounted to substitute the explosive pill, if defective.

We claim:

1. Explosive priming device, comprising a pill of explosive material, which covers the open end of a frusto-conical, blind bottomed explosion chamber, and a percussion pin adapted to strike said pill at the side opposite with respect to said explosion chamber, including a casing having a through hole, said percussion pin being slidably located at one end of said through hole, without possibility of coming out therefrom, a die member removably mounted at the other end of said through hole, said explosion chamber being formed in the end of said die member which is more internal with respect to said through hole, and said die member being provided with channels by which said explosion chamber communicates with an axial duct, formed in said die member and leading outwardly.

2. Explosive priming device according to claim 1, wherein: said through hole is provided, from one end to the other, with sections having increasing diameter, which are connected by frusto-conical parts or stepped parts.

3. Explosive priming device according to claim 2 wherein: said die member is screwed in the section of greatest diameter of said through hole, so as to lock said explosive pill against the internal end of said percussion pin.

4. Explosive priming device according to claim 1, wherein: peripheral longitudinal slots are provided in said die member, which communicate at one end with radial channels, starting from said explosive pill, and at the other end with a transverse duct, an axial duct leading from the center of the transverse duct to outwardly convey the explosion gases generated by the said pill.

5. Explosive priming device according to claim 1, wherein: the outer end of said axial duct is of polygonally shaped cross section, for the insertion of a screwing and unscrewing wrench.

* * * * *